US007718880B1

(12) United States Patent
Levitan

(10) Patent No.: US 7,718,880 B1
(45) Date of Patent: May 18, 2010

(54) PIANO TUNING HAMMER

(76) Inventor: Daniel Levitan, 530 First St., #6, Brooklyn, NY (US) 11215

( * ) Notice: Subject to any disclaimer, the term of this patent is extended or adjusted under 35 U.S.C. 154(b) by 0 days.

(21) Appl. No.: 12/378,673

(22) Filed: Feb. 18, 2009

Related U.S. Application Data

(60) Provisional application No. 61/067,120, filed on Feb. 26, 2008.

(51) Int. Cl.
*G10D 3/00* (2006.01)

(52) U.S. Cl. ..... 84/453; 84/454

(58) Field of Classification Search ..... 84/454, 84/459, 453

See application file for complete search history.

(56) References Cited

U.S. PATENT DOCUMENTS

2006/0117934 A1* 6/2006 Fujan ..... 84/459

* cited by examiner

*Primary Examiner*—Kimberly R Lockett

(57) ABSTRACT

One embodiment of an improved piano tuning hammer which eliminates the tilting force which, when a tuner operates a conventional "L"-shaped tuning hammer, invariably accompanies the application of a turning force to a tuning pin mounted in a pin block. The improved hammer has an overall shape like the letter "C," so that its handle lies substantially in the plane of the pin block, allowing the tuner to turn the pin without tilting it. The embodiment presented is lightweight and rigid, and clears the case structures of most pianos.

2 Claims, 1 Drawing Sheet

PIANO TUNING HAMMER

CROSS REFERENCE TO RELATED APPLICATIONS

Figure 1:
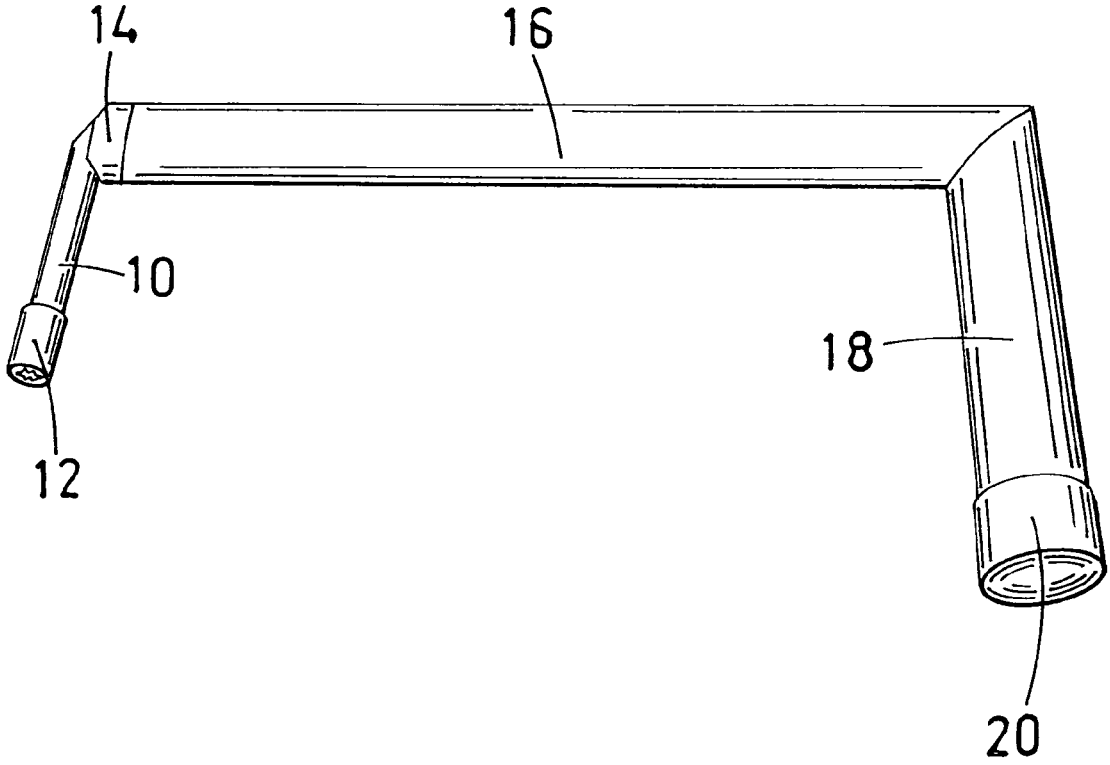

This application claims the benefit of provisional patent application Ser. No. 61/067,120, filed 2008 Feb. 26 by the present inventor.

FEDERALLY SPONSORED RESEARCH

Not Applicable.

SEQUENCE LISTING OR PROGRAM

Not Applicable.

BACKGROUND

1. Field

This application relates to piano tuning hammers, a type of wrench used by piano tuners to adjust the pitch of a piano's strings.

2. Prior Art

Current Practice

A string in a piano is stretched between two pins: a hitch pin, which is fixed; and a tuning pins, which is moveable. A piano tuner adjusts the tension, and thereby the pitch, of a string by moving its attached tuning pin.

A tuning pin is a short, thick section of steel rod held by friction in a hole in a laminated wooden pin block. It has an exposed, squared head at one end, providing a means by which a piano tuner can engage it; a through hole, providing a means of attaching music wire to it; and a threaded portion which is gripped by the pin block, the threads providing a means of backing the tuning pin out of the pin block when necessary.

A tuning pin mounted in a pin block can move in two different ways: it can turn, and it can tilt. Broadly speaking, a piano tuner turns a tuning pin to effect a relatively large change in the pitch of its attached string; while he or she tilts it to effect a relatively small change in the attached string's pitch without further turning the pin. Both types of motion are used by professionals in piano tuning.

Extremely small changes in the position of a tuning pin typically result in significant changes in the pitch of its attached string. Therefore, the better control a tuner has over both the turning and tilting motions of a tuning pin, the better control he or she has over the pitch of the string.

Presently, all professional piano tuners use tuning hammers of the same general design. These conventional tuning hammers are shaped like the letter "L." The short leg of the "L" comprises a tip region that engages the exposed, squared head of the tuning pin; and a head region, axial to the tip region, that elevates the tool above interfering structures in the piano. The long leg of the "L" comprises a shank region, substantially straight and substantially radial to the head region, that gives the operator adequate leverage to move the tuning pin without excessive effort; and a handle region that gives the operator a convenient and comfortable spot to which to apply force. U.S. Pat. No. 777,281 to Eklandsen (1904) depicts a tuning hammer which exemplifies this conventional "L" shape.

A necessary consequence of the elevated position of the shank and handle of a conventional tuning hammer is that some percentage of a turning force applied to its handle, intended to turn the tuning pin, is always diverted to tilting the tuning pin instead. A conventional tuning hammer can be manipulated so as to tilt a tuning pin without turning it, if the operator lifts or depresses its handle; however, the same tuning hammer cannot be manipulated so as to turn the pin without tilting it.

This prying effect is well-known to piano tuners. It is mentioned in many tuning textbooks and manuals, and many techniques of tuning hammer manipulation are designed to compensate for it. The effect is accurately described in U.S. patent application Ser. No. 11/004,215 from Fujan (2004) (Description, Background, Section [0008]):

"Since the handle of a tuning hammer is not in the same plane as the pin block, there will be a prying effect at the tuning pin, and consequently at the pin block. Reduction of this extra prying effect . . . serves to increase the predictability of the tuning process."

This well-known inability of an operator of a conventional hammer to turn a tuning pin without tilting it poses an obstacle to the operator's ability finely to control the pitch of its attached string. It would be of great benefit to a piano tuner to be able to turn a tuning pin without tilting it, but such control is impossible with a conventional tuning hammer.

Prior Art Patents

No efforts in the prior art have gone towards reducing or eliminating the unintended tilting that accompanies every turning motion of a conventional tuning hammer, even though a number of patened tuning hammers do have as their stated purpose to give their operator greater control over the motions of the tuning pin.

A number of patents seek to improve the operator's control over the tuning pin by giving more options for the radial position of the handle than would be possible with a conventional tuning hammer. For example, U.S. Pat. No. 458,568 to Fuchs (1891) describes a tuning hammer with a double tip to provide the operator with twice as many possible handle positions than would be the case with a single tip. U.S. Pat. No. 140,450 to Affleck (1873) shows a tuning hammer in which a ratchet system accomplishes a similar goal.

Several patents seek to improve fine control over the turning of the tuning pin by increasing leverage. As an example, U.S. Pat. No. 1,693,292 to Frattenberger (1928) shows a tuning hammer provided with an offset connection between the shank and head with the stated purpose of increasing the tool's leverage. Other patents describe tuning hammers whose leverage is increased through the use of gears. For instance, U.S. Pat. No. 2,802,388 to Luckenbach (1957) describes a tool that uses gearing axial to the shank to increase fine control of the tuning pin.

U.S. Pat. No. 1,512,699 to Korach (1924) discloses a tool that uses gearing as well. In this instance, the tool itself is axial to the tuning pin, and therefore it does not tilt the tuning pin when the pin is turned. However, this advantage over conventional tuning hammers goes entirely unmentioned in the patent.

U.S. Pat. No. 2,751,805 to Leftly (1956) describes a tool that also uses gearing to increase leverage. The tip in this tool engages the pin near nearer its base than a conventional tip. As the patent notes, this reduces the tilting of the pin: "This [bending] effect is reduced to a minimum by engagement of the pin 11*a* with the inner flange 22*a* much closer to the base of the pin . . . " (Description, Column 3, Lines 23-25). However, this reduction of bending or tilting of the pin is clearly seen as an ancillary benefit, and is not at all the purpose of the patent.

Failure of Prior Art Patents

None of these, or any other, patented improvements to the conventional tuning hammer have been adopted by those skilled in the art. None are mentioned in tool catalogs to the trade; and none are currently in use among professional piano tuners. Instead, every professional piano tuner uses a tuning hammer of the conventional "L" shape.

A prominent deficiency among the patented improvements is their inability to allow the operator directly to perceive the condition of the tuning pin. While tuning, a piano tuner not only continually monitors the pitch of the string being tuned, he or she also continually monitors the condition of the tuning pin. He or she does so because if the pin is not left free of residual stress at the end of the tuning process, it may move slightly after the hammer is removed, and thereby spontaneously change the pitch of its attached string.

A conventional tuning hammer generally has an overall rigidity which allows it to function, not only as a means of applying force, but also as a sensor. In order to be workable, in other words, a tuning hammer must be able not only to transfer force from its operator to the tuning pin; it must also be able to transfer information about the tuning pin back to its operator. By introducing a level of complexity and detachment between the tuning pin and the tuner, many of the prior art improvements reduce the ability of the tool to act as a sensor. Therefore, such tools function in practice less well than a simple, rigid, conventional tuning hammer.

SUMMARY

In accordance with one embodiment, a tuning hammer of substantially rigid construction shaped overall like the letter "C," its elements having a predetermined shape and arrangement such that the handle of the tuning hammer lies substantially in the plane of the pinblock gripping its engaged tuning pin, thereby enabling its operator to apply a substantially pure turning force to the tuning pin, a substantially pure tilting force, or a combination of both.

DRAWINGS—FIGURES

FIG. 1 shows one embodiment of the tuning hammer.

DRAWINGS—REFERENCE NUMERALS

| | | | |
|---|---|---|---|
| 10 | head | 16 | shank |
| 12 | tip | 18 | shank extension |
| 14 | head grip | 20 | handle |

DETAILED DESCRIPTION—FIG 1

One embodiment of the tuning hammer is illustrated in FIG. 1. In this embodiment the tool is lightweight, rigid, and clears interfering structures in most pianos.

The tool in this embodiment has a head 10 composed of 304 stainless steel. Head 10 has a diameter of 0.500" and is 4.125" long overall. Head 10 is threaded at one end to accept a commercially available tuning tip 12 for engaging a tuning pin. Head 10 is beveled at its other end and welded to a head grip 14, also composed of 304 stainless steel. Head grip 14 has an overall diameter of 1.25" and an overall length of 1.000," of which 0.375" is fitted into the shank 16. One end of head grip 14 is tapered conically 0.250" from its end at an angle of 45 degrees, and grooved to accept head 10 at a six degree angle. At its other end head grip 14 is relieved slightly to allow it to fit into shank 16, to which it is welded.

Shank 16 is a tube of 304 stainless steel, with an outside diameter of 1.25", a wall thickness of 0.020", and an overall length of 13.125". At the other end of shank 16 from head grip 14, shank 16 is welded to the shank extension 18, a section of 304 stainless steel tubing of outside diameter 1.25", wall thickness of 0.020", and an overall length of 8.125". Shank extension 18 is mitered at a right angle to shank 16 in such a manner that shank extension 18 lies on the same side of shank 16 as head 10, and in the same plane as head 10.

The handle 20 is fitted by friction to the end of shank extension 18. Handle 20 is made of delrin and has an overall diameter of 1.75" and a length of 1.5". It is drilled out to accept handle extension 18 to a depth of 1.375".

Operation—FIG. 1

In order to tune a piano with the tool of FIG. 1, an operator puts tip 12 on a tuning pin so that shank 16 extends substantially in line with, but in the direction opposed to, the string attached to the tuning pin. If the operator applies a force to handle 20 parallel to the plane of the pin block, the tuning pin feels a substantially pure turning force. If the operator applies force to handle 20 at right angles to the plane of the pinblock, by lifting or depressing it, the tuning pin feels a substantially pure tilting force. The operator can also simultaneously turn and tilt the tuning pin. Thus the operator has extremely precise control over the motions of the tuning pin.

Advantages

In addition to its principal advantage of offering its operator the ability to apply a substantially pure turning force to a tuning pin, while preserving his or her ability to apply a tilting force to the same pin, there are two additional advantages of the improved tuning hammer herein described to which I would like to call attention. One has to do with the consistency of the response of the tool. The other has to do with the increased ease of operation of the tool in both upright and grand pianos.

First Additional Advantage: Consistency of Response

The sockets of commercially available tuning tips have an eight-pointed star configuration, allow them to engage the square head of a tuning pin in eight different positions. This means that when a tuning hammer fitted with a commercially available tip is placed on a tuning pin, its shank and handle occupy one of eight possible postions radial to the tip. The precise position of the shank and handle relative to the string attached to the tuning pin is therefore more or less random.

Tilting motions in a tuning pin have a variable effect on the pitch of the string attached to the tuning pin, according to the direction of tilt. Tilting motions in line with the string have the greatest effect on the string's pitch; tilting motions perpendicular to the string have the least effect. When a conventional tuning hammer is placed on a tuning pin, since the exact position of its shank and handle relative to the string varies in a random way, the effect on the string of tilting the pin varies randomly as well. Since the pin is tilted every time a force is applied to the tuning hammer, this random variability of response reduces the consistency and predictability of the string's response.

In contrast, since the tuning hammer of improved design herein described eliminates the tilting of the tuning pin when it is being turned, when the improved hammer is used to turn a tuning pin the response of its attached string is more uniform and predictable.

Second Additional Advantage: Ease of Use

When a conventional tuning hammer engages a tuning pin mounted in an upright piano, the hammer's handle lies in a vertical plane closer to the operator than the piano's solid back. Therefore, when the operator grips the handle with his or her hand, wrist, and arm in a neutral, relaxed configuration, the operator's arm is unsupported. If the operator wishes to support his or her arm, he or she must bend the wrist in an unnatural and uncomfortable manner to allow his or her elbow to rest on the piano's back.

In contrast, when the improved tuning hammer herein described is used on an upright piano, its handle lies in a horizontal plane directly above the piano's solid back. Therefore, the operator can, keeping his or her hand, wrist, and arm in a neutral, relaxed configuration, conveniently use the solid back of the piano to support his or her elbow.

The improved tuning hammer is also more comfortable and less awkward to use in tuning a grand piano. Most conventional tuning hammers are designed so that the tip and head regions are too short to allow the tool to clear the case structures which, in a grand piano, lie between the tuning pins and the operator. (With some exceptions, most tuners avoid using a tuning hammer whose tip and head region is long enough to allow the hammer to clear these structures, because of the resultant excessive tilting of the tuning pin when it is turned.) Therefore, when tuning a grand piano most tuners engage the tuning pins with the tuning hammer positioned within the interior of the piano. This requires that the operator lift the lid of the piano; stand, or take a relatively high seated position; and reach over interfering case structures into the piano's interior. Furthermore, case structures at the right and left ends of the piano are typically too high to allow clearance for most conventional tuning hammers. As a result the tuner is forced either to reposition himself or herself awkwardly beyond the end of the piano, or to switch the hand being used to manipulate the hammer.

In contrast, when the improved tuning hammer herein described engages a pin in a grand piano, its shank typically clears the case structures between the tuning pins and the operator, allowing the handle to occupy a position directly above the piano keys. This allows the operator to leave the piano lid down if desired; to sit comfortably at the keyboard, at any height; and to grip the handle with his or her arms in a comfortable, neutral configuration, without reaching into the piano's interior. Furthermore, the improved tuning hammer can be operated in the extreme ends of the instrument in exactly the same way that it is operated in the center of the instrument.

Conclusion, Ramifications, and Scope

Accordingly, the reader will see that at least one embodiment of the improved piano tuning hammer provides a tool which offers the possibility of much greater control over the turning motion of an engaged tuning pin than a conventional tuning hammer, as well as greater consistency of response and greater ease of use.

While the above description contains many specificities, these should not be construed as limitations on the scope, but rather as an exemplification of one embodiment thereof. Many other variations are possible.

The tool could be made of one or more of a variety of different materials, including but not limited to such substantially rigid materials as steel, titanium, carbon fiber, wood, plastic, and so on.

The tool could have a number of possible specific forms different from that of the embodiment described, all of which would result in a handle placement substantially in the plane of the pin block.

The tool could be made integrally or from any number of separate parts.

The tool or its separate parts could be composed of straight sections or curved sections.

The tool or its separate parts could have a variety of cross-sectional forms, including but not limited to solid, tubular, square, I-beam, and so on.

If made of separate parts, such parts could be fastened to each other at their joints by numerous means, including but not limited to friction fits, welds, pins, threads, collets, bolted flanges, and so on.

The tool could have one single predetermined shape; or, if made of separate parts, it could be constructed so that some of its separate parts are joined by means of an adjustable joint, allowing a single tool to assume a variety of specific shapes.

Thus the scope should not be determined by the embodiment illustrated, but by the appended claims and their legal equivalents.

I claim:

1. A piano tuning hammer, comprising:

(a) a main body having an overall shape like that of the letter "C;"

(b) a tip region at a first endpoint of said main body, said tip region providing a means of engaging a tuning pin mounted in a pin block of a piano; and (c) a handle region at a second endpoint of said main body;

said main body having a predetermined shape such that said handle region is positioned substantially in the plane of said pin block.

2. The piano tuning hammer of claim 1, wherein the main body comprises (a) a head region, contiguous to, and substantially axial to, said tip region;

(b) a shank region, contiguous to, and substantially radial to, said head region;

(c) a shank extension region, contiguous to, and substantially radial to, said shank region, and substantially parallel to said head region; said shank extension region being additionally contiguous to, and substantially axial to, said handle region.

* * * * *